US005362220A

United States Patent [19]

Amano et al.

[11] Patent Number: 5,362,220

[45] Date of Patent: Nov. 8, 1994

[54] ROTOR-TYPE OIL PUMP

[75] Inventors: Yukihisa Amano; Ikuo Misumi, both of Atsugi, Japan

[73] Assignee: Unisia Jecs Corporation, Atsugi, Japan

[21] Appl. No.: 199,484

[22] Filed: Feb. 22, 1994

[30] Foreign Application Priority Data

Feb. 22, 1993 [JP] Japan ..... 5-031858

[51] Int. Cl.[5] ..... F04C 2/10

[52] U.S. Cl. ..... 418/171

[58] Field of Search ..... 418/166, 171

[56] References Cited

U.S. PATENT DOCUMENTS 4,504,202 3/1985 Saegusa ..... 418/171
4,673,342 6/1987 Saegusa ..... 418/171
5,249,942 10/1993 Torii et al. ..... 418/171

*Primary Examiner*—Richard E. Gluck
*Assistant Examiner*—Charles G. Freay
*Attorney, Agent, or Firm*—Bachman & LaPointe

[57] ABSTRACT

A rotor-type oil pump for sucking and discharging oil to be supplied to a variety of oil-requiring parts of an automotive engine. The oil pump comprises a generally annular outer rotor which is rotatably disposed in a pump casing. A generally annular inner rotor is disposed eccentrically inside the outer rotor and has an external gear which is partly in mesh with the internal gear of the outer rotor. The outer rotor is designed such that stress at the tooth base section of the internal gear is generally equal to stress at the tooth base section of the external gear of the inner rotor in their dynamic condition, thereby reducing the thickness of the tooth base section of the outer rotor.

6 Claims, 3 Drawing Sheets

ROTOR-TYPE OIL PUMP

BACKGROUND OF THE INVENTION

1. Field of the Invention

This invention relates to improvements in a rotor-type oil pump, and more particularly to such an oil pump suitable for supplying lubricating oil to a variety of oil-requiring parts in an internal combustion engine.

2. Description of the Prior Art

Hitherto a variety of rotor-type oil pumps for the purpose of supplying lubricating oil to oil-requiting parts have been proposed and put into practical use in the field of automotive internal combustion engine. An example of such a rotor-type oil pump is disclosed in Japanese Utility Model Publication No. 3-122283. This rotor-type oil pump includes a generally annular outer rotor which is rotatably disposed in a pump casing. A generally annular inner rotor is disposed eccentrically inside the outer rotor and has an external gear which is partly in mesh with the internal gear of the outer rotor. Upon driving the inner rotor, the outer rotor is rotated thereby accomplishing a pumping action in which oil is sucked and then discharged.

Each of the outer and inner rotors is formed of an iron-base sintered alloy. Additionally, the height and width of teeth, the thickness of a tooth base section and the like of the internal and external gears of outer and inner rotors are so designed that the outer and inner rotors have the generally same static breaking load so as to meet the same durability.

However, difficulties have been encountered in such a conventional oil pump arrangement in which the outer and inner rotors are designed to have the same durability. That is, in such a case, the outer rotor having a larger outer diameter has an excessive stress resistance, in which the tooth base section of the internal gear of the outer rotor is formed too thick. As a result, the oil pump is made large-sized and increased in weight while increasing a power consumed by driving the pump.

SUMMARY OF THE INVENTION

It is an object of the present invention to provide an improved rotor-type oil pump which is high in efficiency and small-sized and light in weight.

Another object of the present invention is to provide an improved rotor-type oil pump which comprises outer and inner rotors which have respectively internal and external gears, in which the outer rotor is so designed that stress at the tooth base section of the internal gear is generally equal to stress at the tooth base section of the external gear of the inner rotor.

A rotor-type oil pump of the present invention comprises a pump casing. A generally annular outer rotor is disposed in the pump casing and having an internal gear. A generally annular inner rotor is rotatably disposed eccentrically inside the outer rotor and has an external gear which is partly in mesh with the internal gear of the outer rotor. The inner rotor is driven to cause the outer rotor to rotate so as to accomplish a pumping action for oil. Additionally, the outer rotor is designed such that stress at a tooth base section of the internal gear is generally equal to stress at a tooth base section of the external gear of the inner rotor in a dynamic condition of the outer and inner rotors.

With the above arrangement, by virtue of the fact that the outer rotor is so designed that the respective stresses at the tooth base sections of the inner and outer rotors are generally equal in the dynamic condition of the rotors, the thickness of the tooth base section of the outer rotor can be reduced to the extent of about ½ of that in the conventional rotor-type oil pump. As a result, the outer peripheral dimension of the outer rotor is reduced and lighten in weight. This makes the oil pump small-sized and light in weight, while reducing a power consumed by rotating the outer rotor.

DETAILED DESCRIPTION OF THE INVENTION

Figure 1:
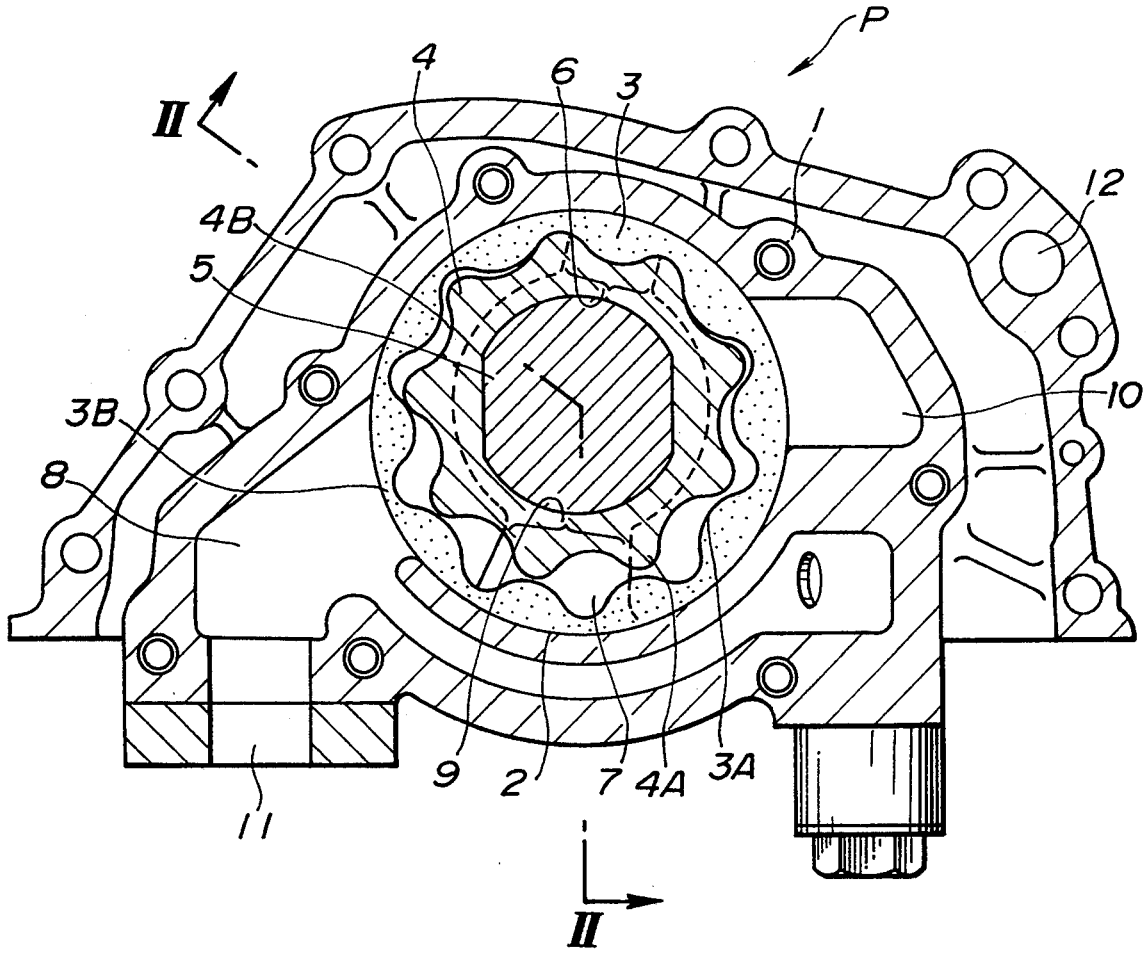
FIG. 1 is a vertical cross-sectional view of an embodiment of a rotor-type oil pump according to the present invention.
Figure 2:
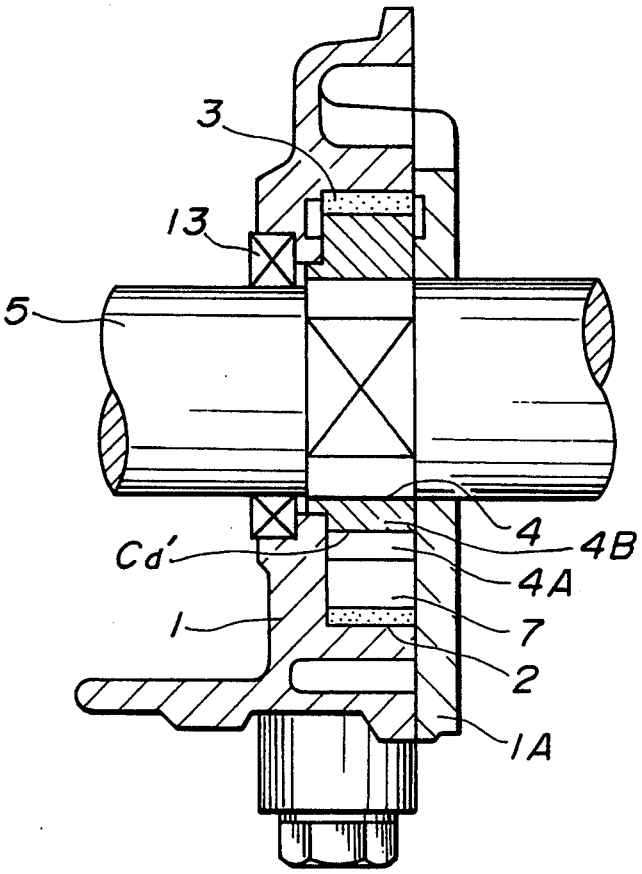
FIG. 2 is a sectional view taken in the direction of arrows substantially along the line II—II of FIG. 1.

Referring now to FIGS. 1 and 2 of the drawings, an embodiment of a rotor-type oil pump according to the present invention is illustrated by the reference character P. The oil pump P of this embodiment is for pressuring oil from an oil reservoir or pan (not shown) of an automotive vehicle so as to supply the oil into a variety of oil-requiring parts in an engine, though not shown. The oil pump P comprises a pump casing 1 which is formed with a generally flat cylindrical depression or chamber 2. A generally cylindrical or annular outer rotor 3 is slidably rotatably disposed in the flat cylindrical depression 2 of the pump casing 1. The outer rotor has a smooth cylindrical outer peripheral surface in slidable contact with the smooth surface of the cylindrical depression 2, and is formed with an annular internal gear 3A and with a central opening (shown but not identified).

A generally cylindrical inner rotor 4 is rotatably disposed inside or in the central opening of the outer rotor 3 and formed with an annular external gear 4A which is partly in mesh with the internal gear 3A of the outer rotor 3 at a meshing region 6 in the depression 2. This is because the inner rotor 4 is eccentric to the outer rotor 3, and the numbers of teeth of the internal and external gears 3A, 4A are different from each other. It will be understood that an axial dimension of the inner rotor 4 is the same as that of the outer rotor 3, and nearly the same as that of the flat cylindrical depression 2. In this embodiment, the outer and inner rotors 3, 4 are formed of an iron-base sintered alloy.

As shown in FIG. 2, a pump cover 1A is fixedly secured to the pump casing 1 by bolts or the likes (not shown) in a manner to cover the flat cylindrical depression 2, confining the inner and outer rotors 4, 3 within the flat cylindrical depression 2. A drive shaft 5 is provided to pierce the pump casing 1 and the pump cover 1A, maintaining an oil-tight seal between it and each of the pump casing and cover 1, 1A by means of an oil seal 13. The inner rotor 4 is securely fitting and coaxially mounted on the drive shaft 5. As shown in FIG. 1, two flat and parallel surface portions (shown but not identified) are formed at the inner peripheral surface of the inner rotor 4 to be respectively in tight contact with the similar two flat and parallel surface portions (shown but not identified) formed at the outer peripheral surface of the drive shaft 5, so that the inner rotor 4 is fittingly and fixedly mounted on the drive shaft 5. In this embodiment, the drive shaft 5 is an end section of a crankshaft of the engine, so that the inner rotor is driven to rotate in relation to engine revolution.

As seen in FIG. 1, the teeth of the inner rotor external gear 4A and the outer rotor internal gear 3A are partly come out of mesh at a non-meshing region 9 so as to leave a confined space or chamber 7 which is filled with oil drawn from an oil inlet chamber 8. The oil inlet chamber 8 is communicated through an oil inlet port 11 with the oil reservoir. The oil filled in the space 7 is discharged to an oil outlet chamber 10 which is communicated through an oil outlet port 12 to the oil-requiring parts in the engine.

Figure 3:
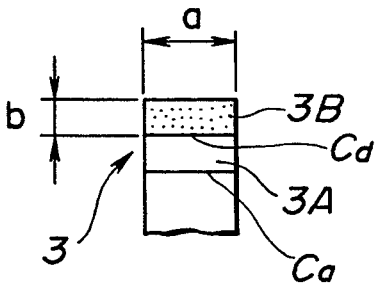
FIG. 3 is a fragmentary sectional view of an outer rotor of the oil pump of FIG. 1.

In FIG. 3, the width (axial dimension) of the outer rotor 3 is represented by the character "a" and is the same as that of the inner rotor 4. The outer rotor 3 includes a tooth section or the internal gear 3A and a tooth base section 3B. It will be understood that the tooth section 3A is defined between the addendum circle Ca and the dedendum circle Cd, while the tooth base section 3B is defined between the dedendum circle and the outer peripheral surface of the outer rotor 3. The thickness (radial dimension) of the tooth base section 3B of the outer rotor 3 is represented by the character "b". It is to be noted that the percentage rate (b/a) of the thickness b relative to the width a of the tooth base section 3B is set within a range from 20% to 40%, without changing the setting of the tooth base section 4B of the inner rotor 4. The tooth base section 4B of the inner rotor 4 is defined between the dedendum circle Cd' (in FIG. 2) and the inner peripheral surface at a position defining a minimum thickness (radial dimension) of the tooth base section 4B at which position the maximum stress is applied.

With the above range in percentage rate of the thickness b relative to the width a of the tooth base section 3B, the stress in the outer rotor 3 becomes generally equal to that in the inner rotor 4 in a dynamic condition (or a condition where the outer and inner rotors 3, 4 are drivingly rotating) of the rotors 3, 4, in which it is preferable that the stress at the tooth section of the outer rotor 3 cannot exceed that at the tooth section of the inner rotor 4.

Figure 4A:
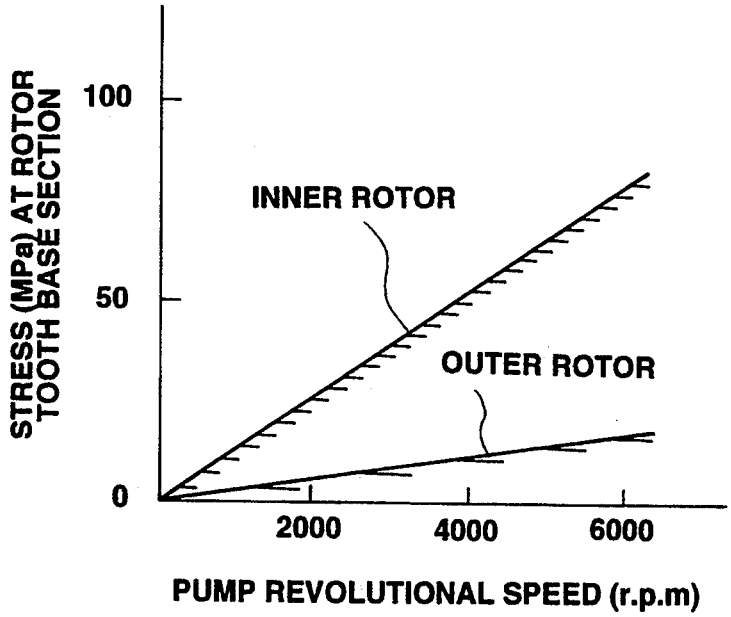
FIG.4 A (PRIOR ART)
FIG. 4A is a graph showing the relationship between stress at the tooth base section of inner and outer rotors and pump revolutional speed in a conventional rotor-type oil pump.
Figure 4B:
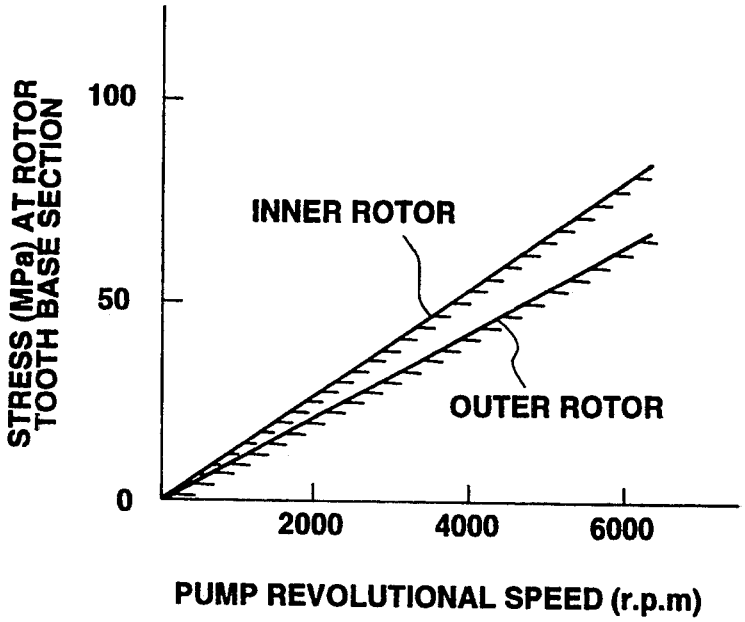
FIG. 4B is a graph similar to FIG. 4A but showing the same relationship in the rotor-type oil pump of FIG. 1.

In order to prove advantageous effects of the present invention, the relationship between stress (MPa) at the tooth base section and pump revolutional speed (r.p.m.) or the rotational speed of the drive shaft is shown in FIGS. 4A and 4B under a condition in which stress at the tooth base section 4B of the inner rotor 4 is the same. FIG. 4A indicates the relationship in case of a conventional rotor-type oil pump in which a is 12 mm and b is 5 mm so that b/a is 41.6%. FIG. 4B indicates the relationship in case of a rotor-type oil pump of the present invention in which a is 12 mm and b is 2.5 mm so that b/a is 20.8%.

As apparent from FIGS. 4A and 4B, if the outer rotor 3 is so designed that the respective stresses at the tooth base sections 4B, 3B of the inner and outer rotors 4, 3 are generally equal in the dynamic condition of the :rotors, the thickness of the tooth base section 3B of the outer rotor 3 can be reduced to the extent of about ½ of that in the conventional rotor-type oil pump. As a result, the outer peripheral dimension of the outer rotor 3 is reduced and lighten in weight. This makes the oil pump small-sized and light in weight, while reducing a power consumed by rotating the outer rotor 3.

What is claimed is:

1. A rotor-type oil pump comprising:

a pump casing;

a generally annular outer rotor rotatably disposed in said pump casing and having an internal gear;

a generally annular inner rotor disposed eccentrically inside said outer rotor and having an external gear which is partly in mesh with the internal gear of said outer rotor, said inner rotor being driven to cause said outer rotor to rotate so as to accomplish a pumping action for oil; and means by which stress at a tooth base section of the internal gear of said outer rotor is generally equal to stress at a tooth base section of the external gear of said inner rotor in a dynamic condition of said outer and inner rotors.

2. A rotor-type oil pump as claimed in claim 1, further comprising means by which the stress at the tooth base section of the internal gear of said outer rotor is lower than the stress at the tooth base section of the external gear of said inner rotor in said dynamic condition.

3. A rotor-type oil pump as claimed in claim 1, wherein a thickness of the tooth base section of the internal gear of said outer rotor is within a range from 20% to 40% of a width of the same tooth base section.

4. A rotor-type oil pump as claimed in claim 3, wherein the width of the tooth base section of the internal gear of said outer rotor is equal to a width of the tooth base section of the external gear of said inner rotor.

5. A rotor-type oil pump as claimed in claim 4, wherein the width of the tooth base section of the internal gear of said outer rotor is equal to a width of a tooth section of the external gear of the inner rotor.

6. A rotor-type oil pump as claimed in claim 1, wherein each of said outer and inner rotors is formed of an iron-base sintered alloy.

* * * * *